US012653269B2

(12) United States Patent
Nishi

(10) Patent No.: US 12,653,269 B2
(45) Date of Patent: Jun. 16, 2026

(54) SHOE SOLE MEMBER AND SHOE

(71) Applicant: ASICS CORPORATION, Kobe (JP)

(72) Inventor: Toshiaki Nishi, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/853,586

(22) PCT Filed: Apr. 8, 2022

(86) PCT No.: PCT/JP2022/017381
§ 371 (c)(1),
(2) Date: Oct. 2, 2024

(87) PCT Pub. No.: WO2023/195167
PCT Pub. Date: Oct. 12, 2023

(65) Prior Publication Data
US 2025/0234958 A1 Jul. 24, 2025

(51) Int. Cl.
*A43B 13/18* (2006.01)
*A43B 13/12* (2006.01)

(52) U.S. Cl.
CPC ..... *A43B 13/187* (2013.01); *A43B 13/122* (2013.01)

(58) Field of Classification Search
CPC ..... A43B 13/187; A43B 13/122
See application file for complete search history.

(56) References Cited

U.S. PATENT DOCUMENTS 4,779,360 A * 10/1988 Bible ..... A43B 3/16 36/7.7
5,499,460 A * 3/1996 Bryant ..... B65D 81/3823 36/2.6
5,617,650 A * 4/1997 Grim ..... A43B 7/147 36/154
5,637,389 A * 6/1997 Colvin ..... A43B 7/34 2/5
5,727,334 A * 3/1998 Cougar ..... A43B 13/36 36/15
5,784,811 A * 7/1998 Mauch ..... A43B 7/1425 36/43

(Continued)

FOREIGN PATENT DOCUMENTS

WO 2008/013060 A1 1/2008
WO 2019/073600 A1 4/2019

(Continued)

OTHER PUBLICATIONS

International Preliminary Report on Patentability and Written Opinion issued in PCT/JP2022/017381; mailed Oct. 17, 2024.

(Continued)

*Primary Examiner* — Bao-Thieu L Nguyen
(74) *Attorney, Agent, or Firm* — Studebaker Brackett PLLC

(57) ABSTRACT

Provided is a shoe sole member which is formed such that at least part of the outer surface thereof serves as a ground-contacting surface and which includes an elastomer substrate and a plurality of particles distributed throughout the elastomer substrate, wherein the material of the plurality of particles is at least one material selected from the group consisting of silicone, polyurethane, polystyrene, polyolefin, and polyvinyl acetate.

6 Claims, 9 Drawing Sheets

(56) References Cited

U.S. PATENT DOCUMENTS

| | | | | |
|---|---|---|---|---|
| 11,653,716 | B2 * | 5/2023 | Nishi | A63B 60/08 36/59 R |
| 2004/0163190 | A1 * | 8/2004 | Loughran | A43D 999/00 12/146 B |
| 2004/0194342 | A1 * | 10/2004 | Steinberg | A43B 13/226 36/11.5 |
| 2006/0130363 | A1 * | 6/2006 | Hottinger | A43B 13/187 36/11.5 |
| 2007/0017124 | A1 * | 1/2007 | Koo | A43B 13/122 36/59 C |
| 2008/0209764 | A1 * | 9/2008 | Fusco | A43B 13/12 36/145 |
| 2009/0239965 | A1 | 9/2009 | Wada et al. | |
| 2011/0277351 | A1 * | 11/2011 | Scoledes | A43B 5/10 264/129 |
| 2017/0273399 | A1 * | 9/2017 | Nishi | C08L 23/12 |
| 2017/0318901 | A1 * | 11/2017 | Nishi | A43B 5/02 |
| 2018/0103719 | A1 * | 4/2018 | Chen | B29D 35/126 |
| 2019/0037969 | A1 | 2/2019 | Busbee et al. | |
| 2019/0039309 | A1 * | 2/2019 | Busbee | B29D 35/126 |
| 2019/0059515 | A1 * | 2/2019 | Koo | A43B 13/22 |
| 2020/0008518 | A1 * | 1/2020 | Souyri | A43B 13/226 |
| 2020/0015545 | A1 * | 1/2020 | Koo | A43B 1/06 |
| 2020/0297062 | A1 | 9/2020 | Sawada et al. | |
| 2020/0305540 | A1 * | 10/2020 | Castro Ramos | A43B 1/02 |
| 2020/0305547 | A1 * | 10/2020 | Tateishi | A43B 13/187 |
| 2021/0045491 | A1 * | 2/2021 | Tateishi | C08L 23/0815 |
| 2021/0145116 | A1 * | 5/2021 | Kvamme | B29D 35/122 |
| 2021/0195993 | A1 * | 7/2021 | Tateishi | A43B 13/187 |
| 2022/0110409 | A1 * | 4/2022 | Koo | A43B 13/26 |
| 2022/0132988 | A1 | 5/2022 | Nishi | |
| 2022/0264998 | A1 * | 8/2022 | Capone | A43B 1/0063 |
| 2022/0403145 | A1 | 12/2022 | Konishi et al. | |
| 2023/0119951 | A1 * | 4/2023 | Nishi | A43B 13/04 36/103 |
| 2023/0389652 | A1 * | 12/2023 | Nishi | C08K 3/16 |
| 2024/0383760 | A1 * | 11/2024 | Yamamoto | C09D 5/006 |

FOREIGN PATENT DOCUMENTS

| | | | |
|---|---|---|---|
| WO | 2020/178987 | A1 | 9/2020 |
| WO | 2021/100738 | A1 | 5/2021 |
| WO | 2021/176685 | A1 | 9/2021 |

OTHER PUBLICATIONS

International Search Report issued in PCT/JP2022/017381; mailed May 31, 2022.

An Office Action, "Notice of Reasons for Refusal," mailed by the Japanese Patent Office on Oct. 31, 2025, which corresponds to Japanese Patent Application No. 2024-513675 and is related to U.S. Appl. No. 18/853,586; with English language translation.

An Office Action, "Decision of Refusal," mailed by the Japanese Patent Office on Jan. 23, 2026, which corresponds to Japanese Patent Application No. 2024-513675 and is related to U.S. Appl. No. 18/853,586; with English language translation.

* cited by examiner

NO ADDITION OF SILICONE RUBBER PARTICLES
(LEFT-LOW MAGNIFICATION/RIGHT-HIGH MAGNIFICATION)

CONTAINING 3 VOL% OF SILICONE RUBBER PARTICLES
(AVERAGE PARTICLE DIAMETER: 5μM)
(LEFT-LOW MAGNIFICATION/RIGHT-HIGH MAGNIFICATION)

CONTAINING 3 VOL% OF SILICONE RUBBER PARTICLES
(AVERAGE PARTICLE DIAMETER: 13μM)
(LEFT:LOW MAGNIFICATION/RIGHT:HIGH MAGNIFICATION)

SHOE SOLE MEMBER AND SHOE

TECHNICAL FIELD

The present invention relates to, for example, a shoe sole member and a shoe including the shoe sole member.

BACKGROUND ART

Conventionally, a shoe sole member having gripping performance on a wet road surface and a shoe including the shoe sole member have been known.

As such a shoe sole member, for example, a shoe sole member including a rubber composition containing rubber and activated carbon has been known (PTL 1).

The shoe sole member described in PTL 1 has gripping performance on a wet road surface, that is, sliding resistance.

CITATION LIST

Patent Literature

[PTL 1]
International Publication No. 2021/176685

DISCLOSURE OF INVENTION

Problems to be Solved by the Invention

Although as a shoe sole member having gripping performance on a wet road surface, that is, sliding resistance, the above-mentioned shoe sole member has been known, there is a continuous demand for a shoe sole member having favorable gripping performance (sliding resistance) on a wet road surface.

In view of the above-mentioned demand, an object of the present invention is to provide a shoe sole member having favorable gripping performance (sliding resistance) on a wet road surface and a shoe including the shoe sole member.

Means for Solving the Problems

A shoe sole member according to the present invention is a shoe sole member having an outer surface at least part of which serves as a ground-contacting surface, the shoe sole member including an elastomer substrate and a plurality of particles distributed in the elastomer substrate, wherein a material for the particles is at least one selected from the group consisting of a silicone, a polyurethane, a polystyrene, a polyolefin, and a polyvinyl acetate, and is different from a material for the elastomer substrate.

A shoe according to the present invention includes the shoe sole member.

DESCRIPTION OF EMBODIMENTS

Hereinafter, an embodiment of a shoe sole member and a shoe according to the present invention will be described with reference to the drawings.

Figure 1:
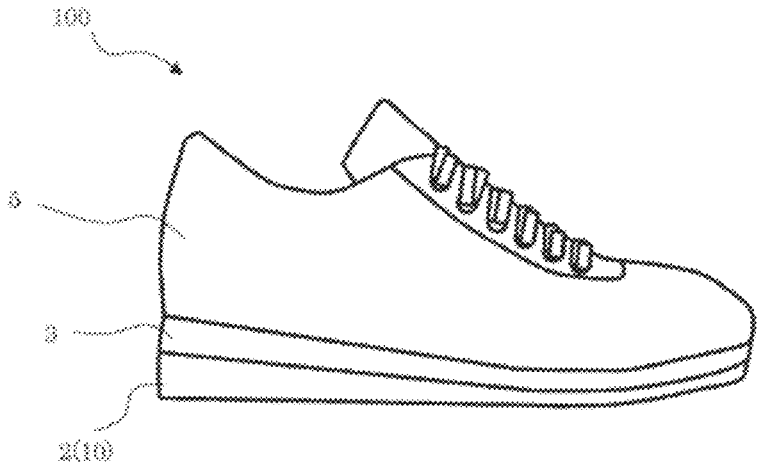
FIG. 1 is a schematic view illustrating the appearance of an example of a shoe sole member and a shoe according to an embodiment.
Figure 2:
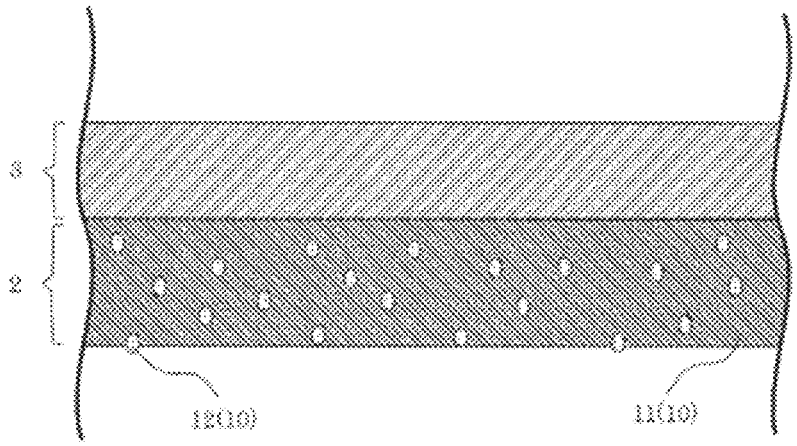
FIG. 2 is a schematic cross-sectional view illustrating a cross-section of the example of the shoe sole member according to the embodiment taken along a vertical direction when the shoe is worn.

A shoe 100 of the present embodiment includes a shoe sole member 10 of the present embodiment. The shoe sole member 10 of the embodiment may have an outer surface at least part of which serves as a ground-contacting surface. In an example of the embodiment, the shoe sole member 10 may be, for example, an outer sole 2 as illustrated in FIG. 1 and FIG. 2. The shoe sole member 10 of the embodiment may be the whole outer sole or part of the outer sole.

Figure 3:
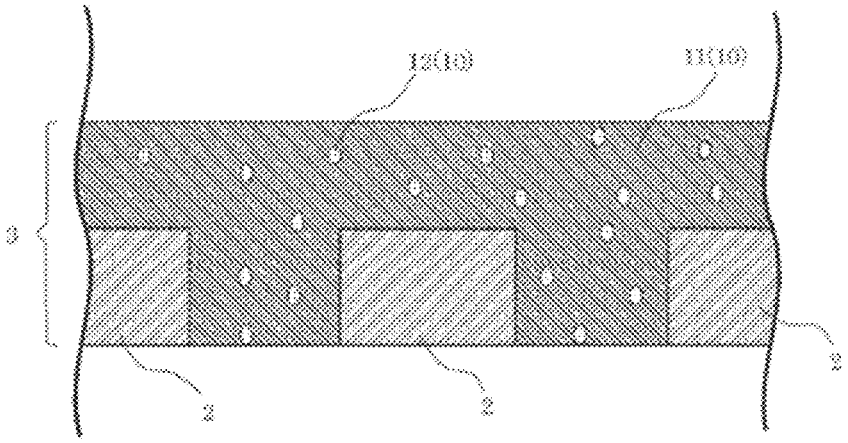
FIG. 3 is a schematic cross-sectional view illustrating a cross-section of another example of the shoe sole member according to the embodiment taken along a vertical direction when the shoe is worn.

For example, in another example of the embodiment, part of the shoe sole member 10 may be disposed on the sole side of a wearer rather than the outer sole 2 as illustrated in FIG. 3. For example, the shoe sole member 10 may be a midsole 3 having a ground-contacting surface. Because each view in the drawings is a schematic view, the aspect ratio of a substance illustrated in the schematic view is not necessarily the same as that of an actual substance.

When the shoe sole member 10 has a plate shape, the largest thickness of the shoe sole member 10 is not particularly limited, and may be, for example, 1 mm or more and 20 mm or less.

The shoe sole member 10 of the embodiment contains an elastomer substrate and a plurality of particles distributed in the elastomer substrate. The material for the particles is at least one selected from the group consisting of a silicone, a polyurethane, a polystyrene, a polyolefin, and a polyvinyl acetate. In other words, the particles contain at least one selected from the group consisting of a silicone, a polyurethane, a polystyrene, a polyolefin, and a polyvinyl acetate.

The durometer A hardness of the shoe sole member 10 is preferably 80 or less. When the durometer A hardness is 80 or less, the gripping performance of the shoe sole member 10 is improved. The durometer A hardness is more preferably 75 or less, still more preferable 70 or less, and further preferably 65 or less. The durometer A hardness may be 40 or more or 50 or more. The durometer A hardness is measured in accordance with JIS K6253-3:2012. The measurement temperature is 23° C.

The tensile elastic modulus of the shoe sole member 10 is preferably 15 MPa or less. When the tensile elastic modulus is 15 MPa or less, the gripping performance of the shoe sole member 10 on a wet road surface may be improved. The tensile elastic modulus is more preferably 10 MPa or less, and further preferably 8 MPa or less. The tensile elastic modulus may be 3 MPa or more. The tensile elastic modulus is measured in accordance with JIS K6251:2017. Specifically, the tensile elastic modulus is calculated from the slope of a stress-strain curve at an initial strain of 5% during straining using a shape of dumbbell No. 2. The measurement temperature is 23° C.

For example, an increase in mass ratio of silica (described later) to a rubber component in a blending composition for production of the shoe sole member 10 can enhance the durometer A hardness and the tensile elastic modulus of the shoe sole member 10. In contrast, a decrease in mass ratio of the silica (described later) to the rubber component can decrease the durometer A hardness and the tensile elastic modulus of the shoe sole member 10.

The shoe sole member 10 preferably contains 1 vol % or more and 5 vol % or less of the particles. When the shoe sole member 10 contains 1 vol % or more of the particles, the gripping performance of the shoe sole member 10 on a wet road surface may be improved. In contrast, when the shoe sole member 10 contains 5 vol % or less of the particles, the strength and the wear resistance of the shoe sole member 10 may be increased.

The shoe sole member 10 may contain 2 vol % or more of the particles. The shoe sole member 10 may contain 4 vol % or less of the particles.

The content (vol %) of the particles in the shoe sole member 10 is determined by the following equation from the volumes of the elastomer substrate and the particles that are calculated on the basis of the amounts of the blended elastomer substrate and the blended particles.

Content (vol %) of a plurality of particles=[(volume of a plurality of particles)/(volume of elastomer substrate+volume of the particles)]×100

In the above-mentioned equation, the volumes of the elastomer substrate and the particles are each calculated by an equation: (volume)=(mass)/(density or specific gravity). For example, the volume (unit: $cm^3$) of the particles is calculated by dividing the total amount (unit: g) of the particles by the density or specific gravity (unit: $g/cm^3$).

The content (vol %) of the particles in the shoe sole member 10 is determined by the following method in addition to the above-mentioned method. More specifically, a region of at least 0.01 $mm^2$ (10,000 $\mu m^2$) in a surface or a cross-section of the shoe sole member 10 is observed. As an observation means, an electron microscope, an optical microscope, a microscope, or the like can be used. A portion of the elastomer substrate is observed as a continuous phase, and the particles are observed as dispersion phases. The proportion of the total area of the dispersion phases to the entire area of an observation subject is calculated. The calculated value is the above-mentioned content (vol %).

The content may be calculated by image analysis of an observed image.

The elastomer substrate may be a cross-linked product of a rubber composition containing at least a rubber component. Examples of the rubber component include an isoprene rubber, a styrene-butadiene rubber, a butadiene rubber, an ethylene-propylene-diene rubber (EPDM), a natural rubber (NR), an epoxidized natural rubber (ENR), an acrylonitrile-butadiene rubber (alias name: a nitrile rubber, or NBR), and a chloroprene rubber (CR). The rubber composition may further contain a filler, a coupling agent, a cross-linker, or the like.

The elastomer substrate may be formed from a thermoplastic elastomer material. The elastomer substrate may be a foam or a non-foam.

The isoprene rubber is not particularly limited as long as it is a rubber obtained from a polymer of isoprene. The isoprene rubber generally has a cis-1,4-polyisoprene structure in the molecule. The isoprene rubber may have a 1,2-polyisoprene structure, a 3,4-polyisoprene structure, a 1,2-polyisoprene structure, or a trans-1,4-polyisoprene structure in the molecule.

The styrene-butadiene rubber is not particularly limited as long as it is a rubber obtained from a copolymer of styrene and butadiene. The styrene-butadiene rubber is, for example, a rubber obtained from a copolymer of styrene and 1,3-butadiene.

The styrene content in the styrene-butadiene rubber is preferably 20 mass % or more, more preferably 30 mass % or more, and further preferably 40 mass % or more. The styrene content may be 60 mass % or less or 50 mass % or less. The styrene content is determined in accordance with JIS K6239.

As the styrene-butadiene rubber, a styrene-butadiene rubber obtained by emulsion polymerization, a styrene-butadiene rubber obtained by solution polymerization, or the like can be adopted. The styrene-butadiene rubber is preferably a styrene-butadiene rubber obtained by solution polymerization in that block arrangement or random arrangement in the molecule is properly adjusted by living polymerization using an organolithium catalyst or the like.

The number average molecular weight of the styrene-butadiene rubber may be, for example, approximately 10,000 or more and approximately 500,000 or less.

The butadiene rubber is not particularly limited as long as it is a rubber obtained from a polymer of butadiene. The butadiene rubber may be, for example, a so-called low-cis butadiene rubber or high-cis butadiene rubber. In the low-cis butadiene rubber, a main unit constituting a molecular chain is a trans-1,4 unit, and another unit is a 1,2 unit (vinyl unit) or a cis-1,4 unit. In the high-cis butadiene rubber, 80% or more of a unit constituting a molecular chain is a cis-1,4 unit. The high-cis butadiene rubber is preferred.

The butadiene rubber may be a butadiene rubber other than the above-mentioned general butadiene rubber. Examples of the butadiene rubber include functional group-containing butadiene rubbers in which a functional group, such as a hydroxy group, a carboxy group, an acrylic group, or an isocyanate group, is introduced into the terminal of the molecule.

The ethylene-propylene-diene rubber (EPDM) is not particularly limited as long as it is a rubber obtained from a copolymer of ethylene, propylene, and diene. As a diene in the ethylene-propylene-diene rubber (EPDM), 5-ethylidene- 2-norbornene (ENB) is generally adopted. As part of the diene, dicyclopentadiene (DCP) or 1,4-hexadiene (HD) may be adopted. The copolymerization ratio by mass of ethylene to propylene, ethylene: propylene, may be, for example, 0.1 to 9:1. In other words, the copolymerization ratio may be a copolymerization ratio of 10 parts by mass or more and 900 parts by mass or less of ethylene to 100 parts by mass of propylene. The copolymerization ratio by mass of the total amount of ethylene and propylene to the amount of diene, (ethylene and propylene): diene, may be, for example, 4 to 99:1. In other words, the copolymerization ratio may be a copolymerization ratio of 4 parts by mass or more and 99 parts by mass or less of ethylene and propylene in total to 1 part by mass of diene.

The elastomer substrate may contain at least one selected from the group consisting of a cross-linked isoprene rubber, a cross-linked styrene-butadiene rubber, a cross-linked butadiene rubber, a cross-linked ethylene-propylene-diene rubber, a cross-linked natural rubber, a cross-linked epoxidized natural rubber, a cross-linked acrylonitrile-butadiene rubber (alias name: nitrile rubber), a cross-linked chloroprene rubber, a polystyrene-based thermoplastic elastomer, a polyolefinic thermoplastic elastomer, a polyurethane-based thermoplastic elastomer, a polyester-based thermoplastic elastomer, a polyamide-based thermoplastic elastomer, a polybutadiene-based thermoplastic elastomer, and an ethylene-vinyl acetate copolymer (EVA).

The content of the rubber component (containing the isoprene rubber, the styrene-butadiene rubber, the butadiene rubber, the ethylene-propylene-diene rubber, and the like) in the rubber composition is preferably 30 mass % or more, and more preferably 40 mass % or more. The shoe sole member 10 may be therefore moderately soft. Accordingly, the shoe 100 including the shoe sole member 10 may have a favorable fit to the sole of the wearer and favorable flexibility during walking. The content of the rubber component in the rubber composition may be 90 mass % or less or 80 mass % or less.

In the embodiment, the rubber composition may contain silica (silica particles) as a filler. The silica may be dry silica or wet silica. The silica contained in the rubber composition is granular.

The dry silica is obtained in a shape similar to primary particles by a dry method, such as a combustion method or an arc method. The dry silica is preferably fumed silica. The average particle diameter of the dry silica is preferably 5 nm or more and 50 nm or less.

The wet silica is obtained as aggregated particles by a wet method, such as a sedimentation method or a gelling method.

The rubber composition preferably contains the silica in an amount of 20 parts by mass or more and 100 parts by mass or less relative to a total amount of the rubber component (styrene-butadiene rubber, butadiene rubber, isoprene rubber, EPDM, and the like) of 100 parts by mass.

In the embodiment, the rubber composition preferably contains at least one of a coupling agent and a cross-linker, and more preferably contains both of the coupling agent and the cross-linker.

The coupling agent is a compound having at least an alkoxysilane structure in the molecule. The rubber composition preferably contains the coupling agent in an amount of 5 parts by mass or more and 15 parts by mass or less relative to 100 parts by mass of the silica.

Examples of the coupling agent include a mercapto-based silane coupling agent, a monosulfide-based silane coupling agent, an epoxy-based silane coupling agent, and a tetrasulfide-based silane coupling agent.

The cross-linker that may be contained in the rubber composition is a compound for accelerating a cross-linking reaction of the rubber component in the rubber composition. Examples of the cross-linker include an organic peroxide and sulfur.

Examples of the organic peroxide include 1,1-bis(1,1-dimethylethylperoxy)cyclohexane, 1,1-bis(1,1-dimethylbutylperoxy)cyclohexane, butyl 4,4-bis[(t-butyl) peroxy] petanoate, dicumyl peroxide, t-butyl α-cumyl peroxide, 2,5-dimethyl-2,5-bis(t-butylperoxy) hexane, 2,5-bis(t-butylperoxy)-2,5-dimethyl-3-hexine, dibenzoyl peroxide, bis(4-methybenzoyl) peroxide, 2,5-dimethyl-2,5-bis(benzoylperoxy) hexane, t-butyl peroxybenzoate, t-hexyl peroxybenzoate, and 1,1-bis(t-butyldioxy)-3,3,5-trimethyl cyclohexane.

The rubber composition may contain sulfur as the cross-linker, and a cross-linking accelerator for accelerating a cross-linking reaction by sulfur. Examples of the cross-linking accelerator include a thiazole-based cross-linking accelerator and a thiuram-based cross-linking accelerator.

Examples of the thiazole-based cross-linking accelerator include 2-mercaptobenzothiazole, zinc 2-mercaptobenzothiazole, 2-mercaptothiazoline, dibenzothiazyl disulfide (di-2-benzothiazolyl disulfide), 2-(2,4-dinitrophenylthio) benzothiazole, 2-(N,N-diethylthiocarbamoylthio) benzothiazole, 2-(2,6-dimethyl-4-morpholinothio)benzohiazole, and 2-(4'-morpholinodithio)benzothiazole.

Examples of the thiuram-based cross-linking accelerator include tetramethylthiuram disulfide (TMTD), tetraethylthiuram disulfide, tetramethylthiuram monosulfide, and dipentamethylenethiuram disulfide.

The rubber composition may contain a fatty acid. The fatty acid may be in a state of a salt, such as a metal salt or an ammonium salt. Examples of the fatty acid include lauric acid, myristic acid, palmitic acid, stearic acid, and behenic acid. Examples of a salt of the fatty acid include a magnesium salt, a calcium salt, and a zinc salt.

In the embodiment, the rubber composition preferably contains the silica in the amount of 40 parts by mass or more and 80 parts by mass or less relative to 100 parts by mass of the rubber component. The rubber composition may contain as a filler carbon black particles, calcium carbonate particles, magnesium carbonate particles, or the like.

In the shoe sole member 10 of the embodiment, the particles are distributed in the elastomer substrate as described above. The shapes of the particles are not particularly limited. The particles may have, for example, a spherical shape, a polygonal shape, or an amorphous shape.

At least part of the particles preferably has a spherical shape. At least a half of the particles more preferably has a spherical shape. Ther term "spherical shape" includes a true spherical shape and an ellipsoid shape, such as a prolate spheroid shape or an oblate spheroid shape.

The proportion of the particles having a spherical shape relative to the whole particles is preferably 80% or more, more preferably 90% or more, and further preferably 99% or more.

The shapes of the particles are determined using the observation image in which the cut surface of the shoe sole member 10 that is observed with an electron microscope. More specifically, at least 50 particles of particles observed in the observation image are observed, and the shapes of the particles are determined by visual check. The electron microscope may be a transmission electron microscope or a scanning electron microscope.

The average aspect ratio of the particles is preferably within the range of 1:1 to 1:10. In other words, the ratio of the maximum diameter (longest diameter) of each of the particles to the minimum diameter (shortest diameter) thereof is preferably 1 or more and 10 or less on average. When the average aspect ratio is 10 or less, the gripping performance of the shoe sole member 10 on a wet road surface may be improved. More specifically, an average aspect ratio of 10 or less decreases the average of the differences between the maximum diameters and the minimum diameters of the particles, and hence the particles in the proximity of the ground-contacting surface are more likely to be separated from the elastomer substrate upon contact of the ground-contacting surface of the shoe sole member 10 with a wet road surface. Accordingly, at a portion where each of the particles is separated on a surface portion of the elastomer substrate, a hollow (pore) is formed. Thus, it is considered that higher gripping performance is exerted (described later in detail). The average aspect ratio is more preferably within the range of 1:1 to 1:5, and further preferably within the range of 1:1 to 1:3.

The proportion of the particles having the above-mentioned aspect ratio relative to the whole particles is preferably 80% or more, more preferably 90% or more, and further preferably 99% or more.

The average aspects ratio of the particles are determined using the observation image in which the cut surface of the shoe sole member 10 that is observed with an electron microscope. More specifically, at least 50 particles of particles observed in the observation image are observed, and the minimum diameters (shortest diameters) and the maximum diameters (longest diameters) of the particles are measured. The aspect ratio (the ratio of the maximum diameter to the minimum diameter) of each of the particles is calculated. The arithmetic average value of the calculated aspect ratios is calculated and determined as the average aspect ratio. The aspect ratio of each of the particles is measured regardless of the shapes of the particles. The electron microscope may be a transmission electron microscope or a scanning electron microscope.

The average particle diameter of the particles is preferably 1 μm or more, and more preferably 3 μm or more. The average particle diameter of the particles is preferably 100 μm or less, and more preferably 50 μm or less.

When the average particle diameter is 1 μm or more, the above-mentioned phenomenon in which the particles are separated from the elastomer substrate may more easily occur.

When the average particle diameter is 100 μm or less, there is an advantage in which the strength of the shoe sole member 10 is kept higher.

The average particle diameter of the particles is determined using the observation image in which the cut surface of the shoe sole member 10 that is observed with an electron microscope. More specifically, the maximum diameters of at least 50 particles observed in the observation image are measured, and the arithmetic average of the measured values is calculated as the average particle diameter. The electron microscope may be a transmission electron microscope or a scanning electron microscope.

The material for the particles distributed in the elastomer substrate are at least one selected from the group consisting of a silicone, a polyurethane, a polystyrene, a polyolefin, and a polyvinyl acetate as described above. The entire of the material for each of the particles may not be the above-mentioned material as long as at least part of each of the particles includes the material. For example, each of the particles may include a core portion and a surface layer portion that covers the core portion, and any one of the core portion and the surface layer portion may include the above-mentioned material.

Examples of the silicone include a polydimethylsiloxane or a modified product thereof, a silicone rubber, and a silicone resin.

Examples of the polyurethane include polyurethane elastomers, such as a thermosetting polyurethane and a thermoplastic polyurethane.

Examples of the polystyrene include a general-purpose polystyrene (GPPS) and a high impact polystyrene (HIPS).

Examples of the polyolefin include a polyethylene, a polypropylene, and a poly(ethylene/propylene). The polyethylene may be a low-density polyethylene or a high-density polyethylene. The polypropylene may be any of an isotactic polypropylene, a syndiotactic polypropylene, and an atactic polypropylene.

Examples of the polyvinyl acetate include an ethylene-vinyl acetate copolymer.

The material for the elastomer substrate differs from the material for the particles. The expression "the material differs from" indicates that in comparison of a polymer compound forming the elastomer substrate and a polymer compound forming the respective particles, repeating structural units in the molecules differ from each other. When the elastomer substrate or the particles are each formed from a mixture of polymer compounds, a polymer compound accounting for the largest proportion of polymer compounds contained in the elastomer substrate is compared with a polymer compound accounting for the largest proportion of polymer compounds contained in the particles. When in the comparison, repeating structural units in the molecules differ from each other, the material for the elastomer substrate differs from the materials for the particles.

To describe in more detail, in comparison of a monomer composition for synthesizing one of the compared polymer compounds with a monomer composition for synthesizing the other, if at least one monomer in the former monomer composition differs from at least one monomer in the latter monomer composition, the polymer compound is judged to differ from the other polymer compound. Even if the former monomer composition and the latter monomer composition each contain the identical monomer, the above-mentioned judgement is not affected.

In order to discriminate monomeric units consisting the polymer compounds, a method for analyzing the polymer compounds through Fourier-transform infrared spectroscopy (FT-IR), pyrolysis gas chromatography-mass spectrometry (Py-GCMS), or the like can be adopted.

As a method for separating the particles from the shoe sole member 10, for example, a method in which the particles are collected with tweezers or the like while the surface or cross-section of the shoe sole member 10 is observed with an optical microscope or a microscope is adopted. When the elastomer substrate is an uncross-linked product (uncross-linked rubber), for example, a method in which only the elastomer substrate is dissolved in an organic solvent to collect the undissolved particles, or the like is adopted.

The shoe sole member 10 of the embodiment may further contain a component other than the above-mentioned components as long as the effects of the present invention are not significantly impaired. The elastomer substrate (rubber composition) may appropriately contain, for example, a hardness adjustor, such as a paraffinic or naphthene-based process oil, a tackifier, such as a terpene resin, an antiaging agent, a processing aid, an inorganic filler (filler), an antibacterial agent, a perfume, or the like.

The shoe sole member 10 of the embodiment is the shoe sole member 10 having an outer surface at least part of which serves as a ground-contacting surface, and includes the elastomer substrate and the particles distributed in the elastomer substrate. The material for the particles is at least one selected from the group consisting of a silicone, a polyurethane, a polystyrene, a polyolefin, and a polyvinyl acetate.

In the embodiment, the material for the elastomer substrate differs from the material for the particles, and hence under contact of the ground-contacting surface of the shoe sole member 10 with a wet road surface, the particles in the proximity of the ground-contacting surface are easily separated from the elastomer substrate.

Accordingly, at a portion where each of the particles is separated on a surface portion of the elastomer substrate, a hollow (pore) is formed. In addition, because the elastomer substrate has rubber elasticity, the elastomer substrate is easily compression-deformed by a pressure when the shoe sole member 10 is brought into contact with the ground.

Accordingly, a gas is discharged from the formed hollow (pore), and a portion near the hollow may be pressed by the atmospheric pressure corresponding to the amount of the discharged gas. This state may be kept for a relative long time under a wet situation with water. Thus, it is considered that wet gripping performance is exerted. As a result, the gripping performance of the shoe sole member 10 on a wet road surface may be improved. When the water repellency of the elastomer substrate is relatively high, a gas may have higher affinity to the elastomer substrate than water. It is therefore considered that from balance between the surface free energy of the elastomer substrate and those of the water and gas, a force for extruding water disposed between the elastomer substrate and the road surface by the gas discharged from the hollow (pore) also acts. Accordingly, it is considered that the elastomer substrate is easily brought into direct contact with the road surface, and gripping performance may be improved.

The durometer A hardness of the shoe sole member 10 is preferably 80 or less, or the tensile elastic modulus of the shoe sole member 10 is preferably 15 MPa or less. As described above, the shoe sole member 10 becomes softer, and therefore the elastomer substrate is more easily compression-deformed. Accordingly, higher gripping performance is considered to be exerted. As a result, the gripping performance of the shoe sole member 10 on a wet road surface may be further improved.

The shoe sole member 10 preferably contains 1 vol % or more and 5 vol % or less of the particles. When the shoe sole member 10 contains the particles in an amount falling within the above-mentioned range, the gripping performance of the shoe sole member 10 on a wet road surface may be improved while the strength of the shoe sole member 10 is kept relatively high.

At least part of the particles preferably has a spherical shape. At least part of the particles has a spherical shape, such as a true spherical shape, a prolate spheroid shape, or an oblate spheroid shape, and hence the above-mentioned phenomenon in which the particles are separated from the elastomer substrate more easily occurs. As a result, the gripping performance of the shoe sole member 10 on a wet road surface may be improved.

The average aspect ratio of the particles is preferably within the range of 1:1 to 1:10. The aspect ratio is 10 or less, and hence the above-mentioned phenomenon in which the particles are separated from the elastomer substrate more easily occurs. As a result, the gripping performance of the shoe sole member 10 on a wet road surface may be improved.

The average particle diameter of the particles is preferably 1 μm or more and 100 μm or less. When the average particle diameter of the particles is within the range, the gripping performance of the shoe sole member 10 on a wet road surface may be improved while the strength of the shoe sole member 10 is kept relatively high.

Next, a method for producing the shoe sole member and a method for producing the shoe according to the embodiment will be described.

The shoe sole member of the embodiment is produced, for example, by performing the following steps:

(I) a step of mixing raw materials, such as a rubber component, a filler, and a silane coupling agent (mixing step);

(II) a step of adding a cross-linker to the mixture prepared by the mixing, further mixing the mixture, and forming a sheet from the resultant rubber composition to prepare a pre-molded sheet in an uncross-linked state (sheet formation step); and (III) a step of heating the pre-molded sheet under application of a compression force to prepare the shoe sole member 10 that is a cross-linked product of the rubber composition (cross-linking treatment step).

The shoe of the embodiment is produced, for example, by further performing the following steps:

(IV) a step of pre-treating a surface of the prepared shoe sole member 10, if necessary (pre-treatment step);

(V) a step of disposing an adhesive between the prepared shoe sole member 10 and an other member previously prepared, such as a midsole, and applying a compression force in a thickness direction to a laminate of the shoe sole member 10 and the other member to bond the members (bonding step); and (VI) a step of further joining an upper member and the like to assemble a shoe (assembly step).

In the mixing step (I), for example, the above-mentioned raw materials are kneaded at a temperature of approximately 110° C. to approximately 150° C. using a kneader, such as a Banbury mixer or a pressure kneader.

In the sheet formation step (II), for example, the rubber composition is supplied to a calender roll or the like, and further kneaded using the calender roll. From the kneaded rubber composition, a sheet is formed using the calender roll or the like to prepare a pre-molded sheet in an uncross-linked state.

In the cross-linking treatment step (III), for example, the pre-molded sheet for the shoe sole member 10 disposed in a mold is heat-pressed using a heat press equipped with the mold. Thus, the pre-molded sheet having a desired shape is formed in the mold. At the same time, the rubber composition of the pre-molded sheet for the shoe sole member 10 is subjected to a cross-linking treatment using the heat press to prepare the shoe sole member 10 formed from a cross-linked product (cross-linked rubber).

In the pre-treatment step (IV), at least one of a surface to be bonded of the shoe sole member 10 and a surface to be bonded of the other member is pre-treated, if necessary, in order to enhance the bonding strength after bonding. As the pre-treatment, for example, a treatment for polishing a surface or a treatment for applying a pre-treatment liquid containing an organic solvent is adopted.

In the bonding step (V), for example, an adhesive is applied to a surface of the shoe sole member 10. Next, while a surface to which the adhesive is applied is faced with a surface of the other sheet-shaped member, a compression force is applied in the thickness direction to the laminate of the shoe sole member 10 and the other member. Thus, the shoe sole member 10 is bonded to the other member via the adhesive. The adhesive used in the bonding step may be a general urethane resin-based adhesive.

The shoe 100 including the shoe sole member 10 produced as described above is used, for example, in application to a sport shoe. In addition, the shoe 100 may be used, for example, in application to a sneaker.

The shoe sole member and the shoe of the present invention are as described in the above-mentioned illustrative examples, but the present invention is not limited to the illustrative embodiment. In the present invention, a variety of forms adopted for a general shoe sole member, a general shoe, and the like can be adopted as long as the effects of the present invention are not impaired.

Items disclosed herein include the following inventions.

(1)

A shoe sole member having an outer surface at least a portion of which serves as a ground-contacting surface, the shoe sole member including an elastomer substrate and a plurality of particles distributed in the elastomer substrate, wherein a material for the particles includes at least one selected from the group consisting of a silicone, a polyurethane, a polystyrene, a polyolefin, and a polyvinyl acetate, and is different from a material for the elastomer substrate.

(2)

The shoe sole member according to (1), wherein a durometer A hardness is 80 or less.

(3)

The shoe sole member according to (1) or (2), wherein a tensile elastic modulus is 15 MPa or less.

(4)

The shoe sole member according to any one of (1) to (3), wherein the particles are contained in an amount of 1 vol % or more and 5 vol % or less.

(5)

The shoe sole member according to any one of (1) to (4), wherein at least part of the particles has a spherical shape.

(6)

The shoe sole member according to any one of (1) to (5), wherein an average aspect ratio of the particles is within the range of 1:1 to 1:10.

(7)

The shoe sole member according to any one of (1) to (6), wherein the particles have an average particle diameter of 1 μm or more and 100 μm or less.

(8)

The shoe sole member according to any one of (1) to (7), wherein the elastomer substrate contains at least one selected from the group consisting of a cross-linked isoprene rubber, a cross-linked styrene-butadiene rubber, a cross-linked butadiene rubber, a cross-linked ethylene-propylene-diene rubber, a cross-linked natural rubber, a cross-linked epoxidized natural rubber, a cross-linked acrylonitrile-butadiene rubber (alias name: nitrile rubber), a cross-linked chloroprene rubber, a polystyrene-based thermoplastic elastomer, a polyolefinic thermoplastic elastomer, a polyurethane-based thermoplastic elastomer, a polyester-based thermoplastic elastomer, a polyamide-based thermoplastic elastomer, a polybutadiene-based thermoplastic elastomer, and an ethylene-vinyl acetate copolymer (EVA).

(10)

A shoe including the shoe sole member according to any one of (1) to (9).

EXAMPLES

Hereinafter, the present invention will be described in more detail with reference to Examples, but the present invention is not limited to the Examples.

As described below, a shoe sole member was produced. Table 1 and Table 2 show raw materials for production of shoe sole members in Test Examples and blending compositions of rubber compositions for formation of the shoe sole members.

The raw materials for production of the shoe sole members will be described below.

<Main Raw Materials for Elastomer Substrate>

(a) Rubber component (isoprene rubber: IR)

product name "Nipol IR2200" (manufactured by Zeon Corporation)

(b) Process oil product name "JOMO Process P200" (manufactured by JX Nippon Oil & Energy Corporation)

(c) Silica (wet silica)

product name "ULTRASIL VN3" (manufactured by Degussa AG)

average particle diameter: 18 nm/specific surface area through BET method: 170 ($m^2/g$)

(d) Coupling agent (tetrasulfide-based coupling agent)

chemical name: bis[3-(triethoxysilyl) propyl] tetrasulfide product name "Si-69" (manufactured by Degussa Japan Co., Ltd.)

(e) Fatty acid (stearic acid, commercially available product)

(f) Zinc oxide product name "active zinc oxide" (manufactured by Honjo Chemical Corporation)

(g) Cross-linking co-agent product name "ACTING SL", a compound of dicyclohexylamine and ethylene glycol (manufactured by API Corporation)

(h) Polyethylene glycol 4000 (commercially available product)

(i) Antiaging agent product name "OZONOC33" (manufactured by Ouchi Shinko Chemical Industrial Co., Ltd.)

(j) Antioxidant (dibutyl hydroxy toluene, commercially available product)

(k) Titanium oxide (TiO2)

S: Cross-linker (sulfur)

product name "fine sulfur 200 mesh" (manufactured by Hosoi Chemical Industry Co., Ltd.)

DM: Cross-linking accelerator (thiazole-based cross-linking accelerator)

chemical name: di-2-benzothiazolyl disulfide product name "NOCCELER DM-P" (manufactured by Ouchi Shinko Chemical Industrial Co., Ltd.)

TS: cross-linking accelerator (thiuram-based cross-linking accelerator)

chemical name: tetramethylthiuram monosulfide product name "NOCCELER TS" (manufactured by Ouchi Shinko Chemical Industrial Co., Ltd.)

<Raw Materials for Particles>

(X) Silicone rubber powder (average particle diameter: 5 μm, spherical shape, aspect ratio: 1:1)

product name "KMP-597" (manufactured by Shin-Etsu Chemical Co., Ltd.)

(Y) Silicone rubber powder (average particle diameter: 13 μm, spherical shape, aspect ratio: 1:1)

product name "KMP-598" (manufactured by Shin-Etsu Chemical Co., Ltd.)

Test Examples 1 to 15

Components were mixed in accordance with each blending composition shown in Table 1 and Table 2 to prepare each rubber composition (unvulcanized state) for a shoe sole member. Next, the rubber compositions were each subjected to a heat-pressing treatment for 10 minutes under conditions of 160° C. and 15 MPa and processed with a mold to obtain a cross-linked product. Thus, a shoe sole member (thickness: 2 mm) was produced.

TABLE 1

Unit: part by mass (in part, vol %)

| | Test Example 1 | Test Example 2 | Test Example 3 | Test Example 4 | Test Example 5 | Test Example 6 | Test Example 7 | Test Example 8 | Test Example 9 |
|---|---|---|---|---|---|---|---|---|---|
| (a) | 100.0 | 100.0 | 100.0 | 100.0 | 100.0 | 100.0 | 100.0 | 100.0 | 100.0 |
| (b) | 20.0 | 20.0 | 20.0 | 20.0 | 20.0 | 20.0 | 20.0 | 20.0 | 20.0 |
| (c) | 44.0 | 51.0 | 60.0 | 69.0 | 80.0 | 60.0 | 60.0 | 44.0 | 51.0 |
| (d) | 4.4 | 5.1 | 6.0 | 6.9 | 8.0 | 6.0 | 6.0 | 4.4 | 5.1 |
| (e) | 2.0 | 2.0 | 2.0 | 2.0 | 2.0 | 2.0 | 2.0 | 2.0 | 2.0 |
| (f) | 5.0 | 5.0 | 5.0 | 5.0 | 5.0 | 5.0 | 5.0 | 5.0 | 5.0 |
| (g) | 1.0 | 1.0 | 1.0 | 1.0 | 1.0 | 1.0 | 1.0 | 1.0 | 1.0 |
| (h) | 1.0 | 1.0 | 1.0 | 1.0 | 1.0 | 1.0 | 1.0 | 1.0 | 1.0 |
| (i) | 0.5 | 0.5 | 0.5 | 0.5 | 0.5 | 0.5 | 0.5 | 0.5 | 0.5 |
| (j) | 1.0 | 1.0 | 1.0 | 1.0 | 1.0 | 1.0 | 1.0 | 1.0 | 1.0 |
| (k) | 35.0 | 36.1 | 37.2 | 38.3 | 39.7 | 37.2 | 37.2 | 35.0 | 36.1 |
| S | 2.00 | 2.00 | 2.00 | 2.00 | 2.00 | 2.00 | 2.00 | 2.00 | 2.00 |
| DM | 1.0 | 1.0 | 1.0 | 1.0 | 1.0 | 1.0 | 1.0 | 1.0 | 1.0 |
| TS | 0.1 | 0.1 | 0.1 | 0.1 | 0.1 | 0.1 | 0.1 | 0.1 | 0.1 |
| (X) | — | — | — | — | — | 1.8 | 3.7 | 5.3 | 5.4 |
| (Y) | — | — | — | — | — | — | — | — | — |
| Content of particles | — | — | — | — | — | 1 vol % | 2 vol % | 3 vol % | 3 vol % |
| Physical property value | | | | | | | | | |
| Durometer hardness (A) | 55 | 60 | 65 | 70 | 75 | 65 | 65 | 55 | 60 |
| Tensile elastic modulus [MPa] | 4.9 | 6.5 | 8.2 | 9.7 | 14.0 | 7.9 | 7.4 | 4.7 | 5.8 |

TABLE 2

Unit: part by mass (in part, vol %)

| | Test Example 10 | Test Example 11 | Test Example 12 | Test Example 13 | Test Example 14 | Test Example 15 |
|---|---|---|---|---|---|---|
| (a) | 100.0 | 100.0 | 100.0 | 100.0 | 100.0 | 100.0 |
| (b) | 20.0 | 20.0 | 20.0 | 20.0 | 20.0 | 20.0 |
| (c) | 60.0 | 69.0 | 80.0 | 60.0 | 60.0 | 60.0 |
| (d) | 6.0 | 6.9 | 8.0 | 6.0 | 6.0 | 6.0 |
| (e) | 2.0 | 2.0 | 2.0 | 2.0 | 2.0 | 2.0 |
| (f) | 5.0 | 5.0 | 5.0 | 5.0 | 5.0 | 5.0 |
| (g) | 1.0 | 1.0 | 1.0 | 1.0 | 1.0 | 1.0 |
| (h) | 1.0 | 1.0 | 1.0 | 1.0 | 1.0 | 1.0 |
| (i) | 0.5 | 0.5 | 0.5 | 0.5 | 0.5 | 0.5 |
| (j) | 1.0 | 1.0 | 1.0 | 1.0 | 1.0 | 1.0 |
| (k) | 37.2 | 38.3 | 39.7 | 37.2 | 37.2 | 37.2 |
| S | 2.00 | 2.00 | 2.00 | 2.00 | 2.00 | 2.00 |
| DM | 1.0 | 1.0 | 1.0 | 1.0 | 1.0 | 1.0 |
| TS | 0.1 | 0.1 | 0.1 | 0.1 | 0.1 | 0.1 |
| (X) | 5.6 | 5.8 | 6.0 | 7.5 | 9.5 | — |
| (Y) | — | — | — | — | — | 5.6 |
| Content of particles | 3 vol % | 3 vol % | 3 vol % | 4 vol % | 5 vol % | 3 vol % |

TABLE 2-continued

| Unit: part by mass (in part, vol %) | | | | | | |
|---|---|---|---|---|---|---|
| | Test Example 10 | Test Example 11 | Test Example 12 | Test Example 13 | Test Example 14 | Test Example 15 |
| Physical property value | | | | | | |
| Durometer hardness (A) | 65 | 70 | 75 | 65 | 65 | 65 |
| Tensile elastic modulus [MPa] | 7.6 | 8.7 | 12.5 | 7.8 | 7.3 | 7.5 |

For the test sample for the shoe sole member produced in each of Test Examples, physical properties, performance, and the like were each measured as follows.

<Physical Properties: Measurement of Durometer Hardness of Shoe Sole Member>

For the test sample for the shoe sole member produced in each of Test Examples, the durometer hardness (A type) was measured. The measurement was based on "vulcanized rubber and thermoplastic rubber-determination of hardness-Part 3: durometer hardness (JIS K6253-3:2012)", and performed in an environment of 23° C.

<Physical Properties: Measurement of Tensile Elastic Modulus of Shoe Sole Member>

For the test sample for the shoe sole member produced in each of Test Examples, the tensile elastic modulus was measured. The measurement was based on "vulcanized rubber and thermoplastic rubber—determination of tensile properties (JIS K6251:2017)", and performed in an environment of 23° C. The tensile elastic modulus was calculated from the slope of a stress-strain curve at an initial strain of 5% during straining using a shape of dumbbell No. 2.

<Observation of Surface of Shoe Sole Member with Electron Microscope>

Figure 4A:
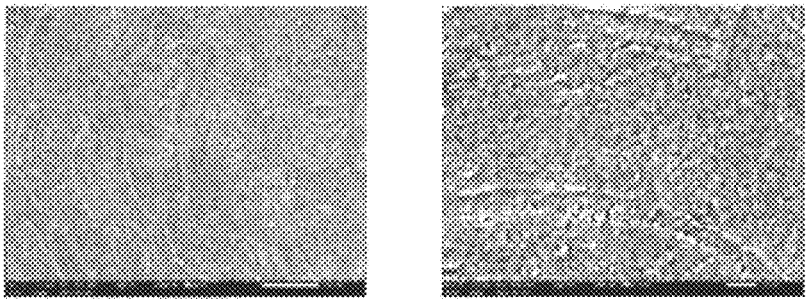
FIG. 4A is photographs illustrating a state of a surface of a shoe sole member in a test example that is observed with an electron microscope.
Figure 4B:
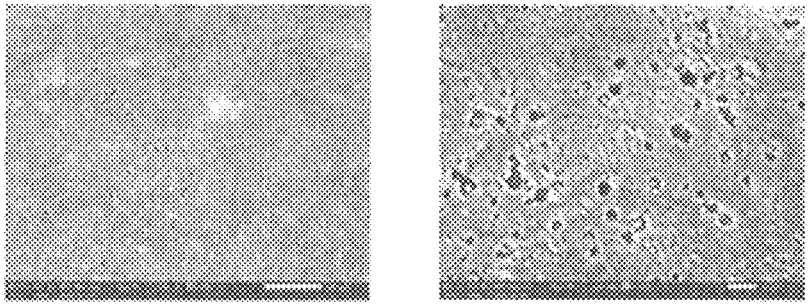
FIG. 4B is photographs illustrating a state of a surface of a shoe sole member in another test example that is observed with an electron microscope.
Figure 4C:
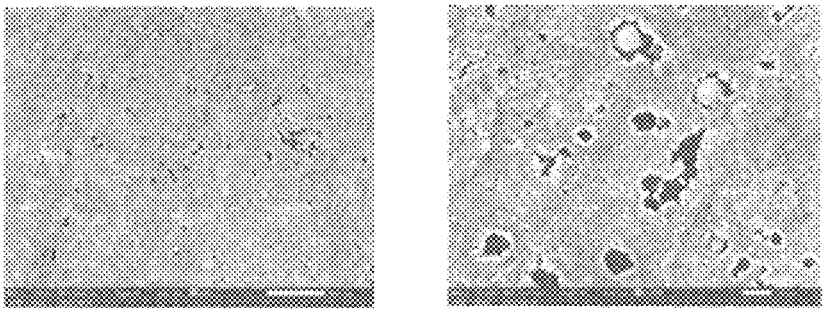
FIG. 4C is photographs illustrating a state of a surface of a shoe sole member in yet another test example that is observed with an electron microscope.

FIG. 4A to FIG. 4C each illustrate observation images of surfaces of the sheet-shaped shoe sole members (test samples) having a thickness of 2 mm produced in Test Examples 3, 10, and 15. During completion of sheet formation, silicone rubber particles were already detached. In a portion where the particles are detached, a hollow (concave portion) was formed.

<Evaluation of Wet Gripping Performance: Measurement of Static Friction Coefficient and Dynamic Friction Coefficient of Shoe Sole Member>

In a water-lubrication state, the static friction coefficient and the dynamic friction coefficient were each measured as follows. In detail, an aluminum cylinder body having a diameter of 10 mm and a width of 6 mm was first prepared. Next, the side surface of the cylinder body was brought into contact with a surface of each test sample for measurement. In the measurement, the vertical load was set to 500 gf (4.91 N), and a sliding speed was set to 10.0 mm/s.

Figure 5:
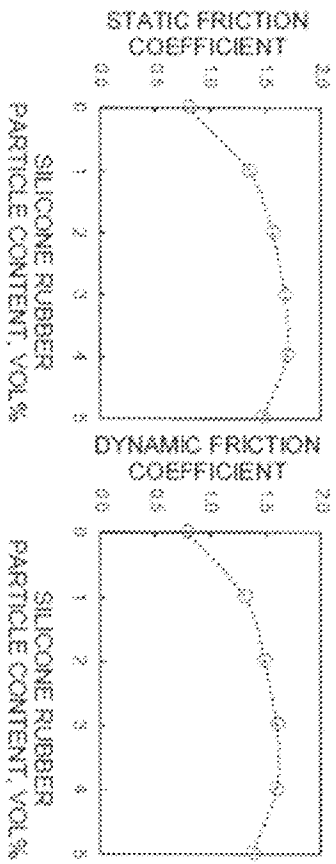
FIG. 5 is graphs showing a relationship between the content of particles and the friction coefficient of shoe sole members in a plurality of test examples.

When the durometer A hardness of the test sample (shoe sole member) is 65 and the average particle diameter of the particles is 5 μm, an influence of the particle content on the static friction coefficient and the dynamic friction coefficient is expressed by a graph in FIG. 5 (Test Examples 3, 6, 7, 10, 13, and 14). Because the test sample (shoe sole member) contains silicone rubber particles, all the static friction coefficient and the dynamic friction coefficient are increased. When the content is especially 3 vol % or more and 4 vol % or less, the static friction coefficient and the dynamic friction coefficient are especially higher.

Figure 6:
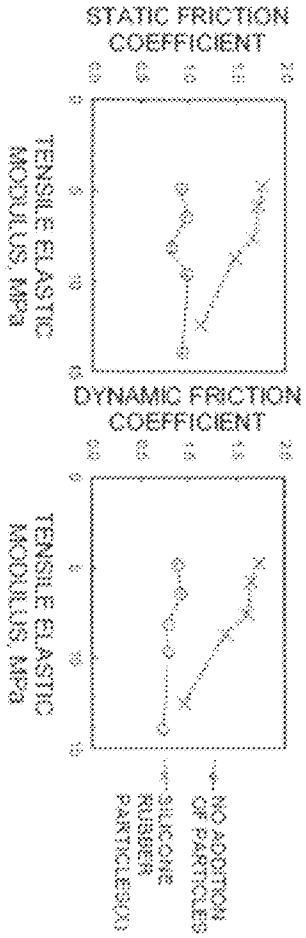
FIG. 6 is graphs showing a relationship between the tensile elastic modulus and the friction coefficient of the shoe sole members in the test examples.
Figure 7:
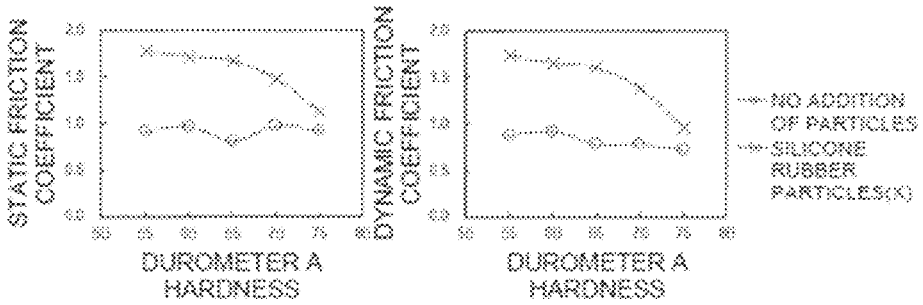
FIG. 7 is graphs showing a relationship between the durometer A hardness and the friction coefficient of the shoe sole members in the test examples.

When the particle content is 0 vol % and when the average particle diameter of the particles is 5 μm and the particle content is 3 vol %, an influence of the elastic modulus (tensile elastic modulus) of the testing sample on the static friction coefficient and dynamic friction coefficient of the test sample is expressed by graphs in FIG. 6 and FIG. 7 (Test Examples 1 to 5 and 8 to 12). An increase in friction coefficient due to blended particles is especially remarkable when the tensile elastic modulus of the test sample (shoe sole member) is low or the hardness is low. When the tensile elastic modulus of the test sample (shoe sole member) is 15 MPa or less, and preferably 10 MPa or less, the friction coefficient is higher. When the durometer A hardness of the test sample (shoe sole member) is 80 or less, and preferably 70 or less, the friction coefficient is higher.

Figure 8:
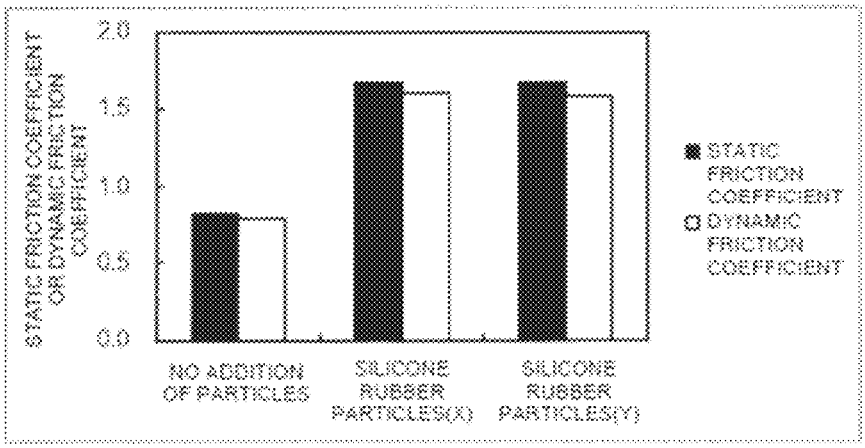
FIG. 8 is a graph showing a relationship between the average particle diameter of particles and the friction coefficient of the shoe sole members in the test examples.

When the durometer A hardness of the test sample (shoe sole member) is 65 and the particles are blended and are not blended, the static friction coefficient and the dynamic friction coefficient are expressed by a graph in FIG. 8 (Test Examples 3, 10, and 15). Regardless of the average particle diameter of the particles, the particles blended in the testing sample (shoe sole member) enhances the friction coefficient.

An increase in content of the silicone rubber particles in the test sample has little influence on the tensile strength, tear strength, and wear resistance of the test sample.

Figure 9:
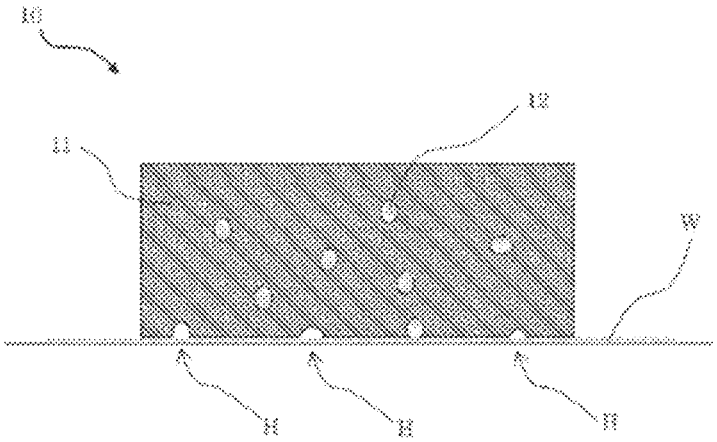
FIG. 9 is a schematic cross-sectional view schematically illustrating a state in which a ground-contacting surface of an example of the shoe sole member according to the embodiment is brought into contact with the ground in a lubrication environment.

As understood from FIG. 5 to FIG. 8, the gripping performance (sliding resistance) of the shoe sole members containing specific particles on a wet road surface is higher than those of the shoe sole member containing no particles. The reason for high gripping performance (sliding resistance) on a wet road surface is considered to be as follows. As schematically illustrated in FIG. 9, when the ground-contacting surface of the shoe sole member is brought into contact with the wet road surface, the particles near the ground-contacting surface are separated from the elastomer substrate. Thus, at a portion where each of the particles is separated on a surface portion of the elastomer substrate, a hollow H (pore) is formed. In addition, because the elastomer substrate has rubber elasticity, the elastomer substrate is easily compression-deformed by a pressure when the shoe sole member 10 is brought into contact with the ground. Accordingly, a gas is discharged from the formed hollow H (pore), a portion near the hollow may be pressed by the atmospheric pressure corresponding to the amount of the discharged gas. This state may be kept for a relative long time under a wet situation with water (represented by W). Thus, it is considered that wet gripping performance is exerted. As a result, the gripping performance of the shoe sole member 10 on a wet road surface may be improved. Because the elastomer substrate in each of Test Examples above described has relatively high water-repellent properties, it is considered that a gas has higher affinity to the elastomer substrate than water. It is therefore considered that from balance between the surface free energy of the elastomer substrate and those of the water and gas, a force for extruding water disposed between the elastomer substrate and the road surface by the gas discharged from the hollow H (pore) also acts. Accordingly, it is considered that the elastomer substrate is easily brought into direct contact with the road surface, and gripping performance may be improved.

Furthermore, from the results of the following reference experiment, the presence of the hollow H (pore) in the elastomer substrate exerts wet gripping performance.

<Reference Experiment: Evaluation of Wet Gripping Performance of Shoe Sole Member>

Figure 10:
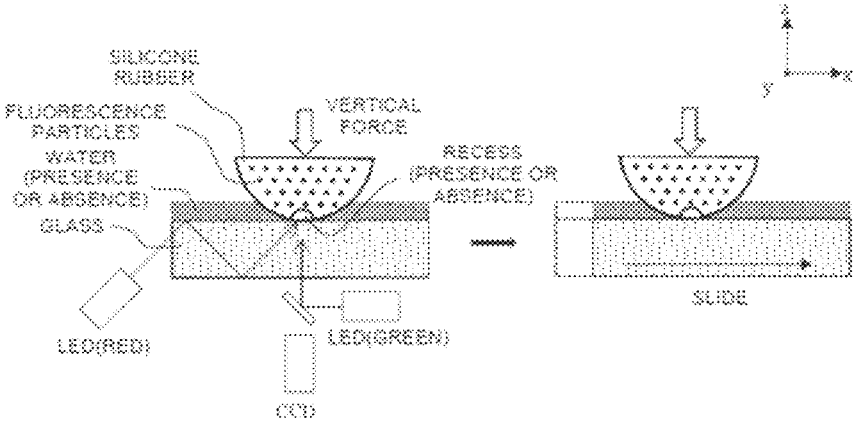
FIG. 10 is a schematic view schematically illustrating a state of a reference experiment.

A hemispheric silicone rubber with a radius of curvature of 7.6 mm (product name "Sylgard 184" manufactured by Dow Corning Toray Co., Ltd.) was prepared as a rubber specimen. A rubber specimen having a surface portion processed so as to form a cubic hollow (recess) with a side length of approximately 100 μm was prepared, and a rubber specimen having a smooth vertex portion was also prepared. A friction test between each of the rubber specimens and a glass plate was performed to evaluate gripping performance (dry gripping performance and wet gripping performance). The test was performed under a water-lubrication condition or a non-lubrication condition at a vertical load of 0.0981 N and a sliding speed of 0.10 mm/s. A contact state between the rubber specimen and the glass was visualized by both a total reflection method and a light interference method, as illustrated in FIG. 10.

Figure 11:
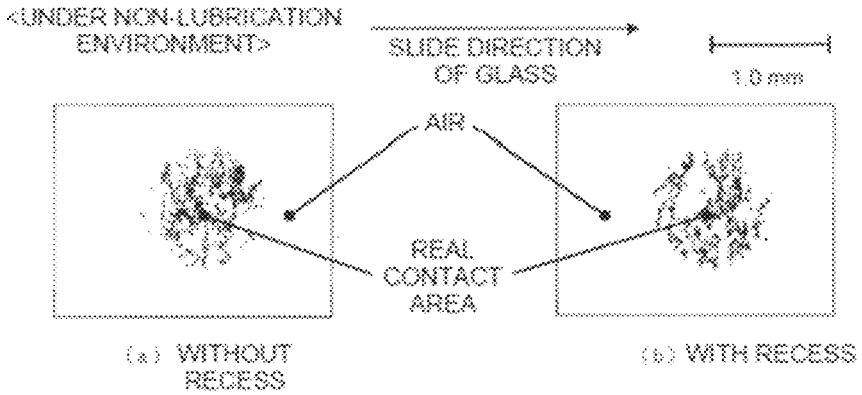
FIG. 11 is photographs of visualized results of the reference experiment.

FIG. 11(*a*) and FIG. 11(*b*) show a contact state between the rubber specimen and the glass when 5.0-mm sliding was applied under a non-lubrication condition. FIG. 11(*a*) shows the results when the rubber specimen having no hollow on its surface portion was used, and FIG. 11(*b*) shows the results when the rubber specimen having a hollow on its surface portion was used. A black portion exhibits contact of the rubber specimen with a glass surface, and a white portion exhibits contact of air with the glass surface. As recognized from FIG. 11, contact of a portion of a surface of the rubber specimen with the glass surface can be confirmed regardless of the presence of the hollow on the surface of the rubber specimen.

Figure 12:
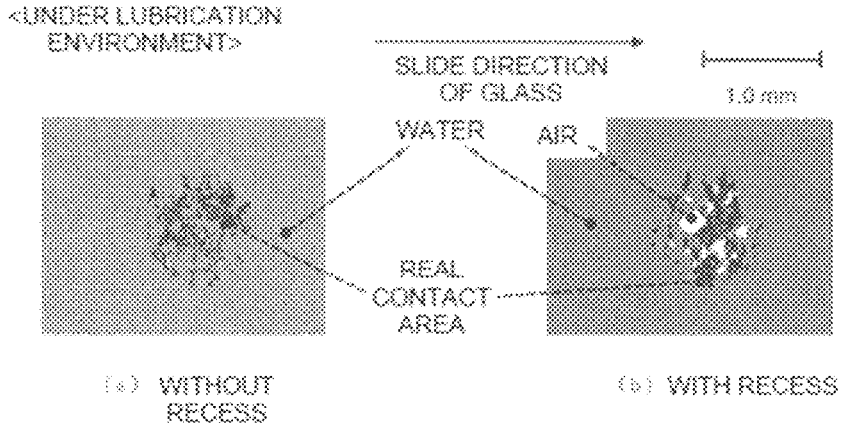
FIG. 12 is photographs of visualized results of the reference experiment.

FIG. 12(*a*) and FIG. 12(*b*) show a contact state between the rubber specimen and the glass when 5.0-mm sliding was applied under a water-lubrication condition. A black portion exhibits a state in which water is brought into contact with glass. As recognized from FIG. 12(*a*) and FIG. 12(*b*), the presence of a plurality of air bubbles can be confirmed in a contact interface between the rubber specimen and the glass by the hollow formed on the surface portion of the rubber specimen. Prior to application of sliding, air remains in the hollow, and after the application of sliding, the air forms air bubbles and diffuses in the contact interface.

Figure 13:
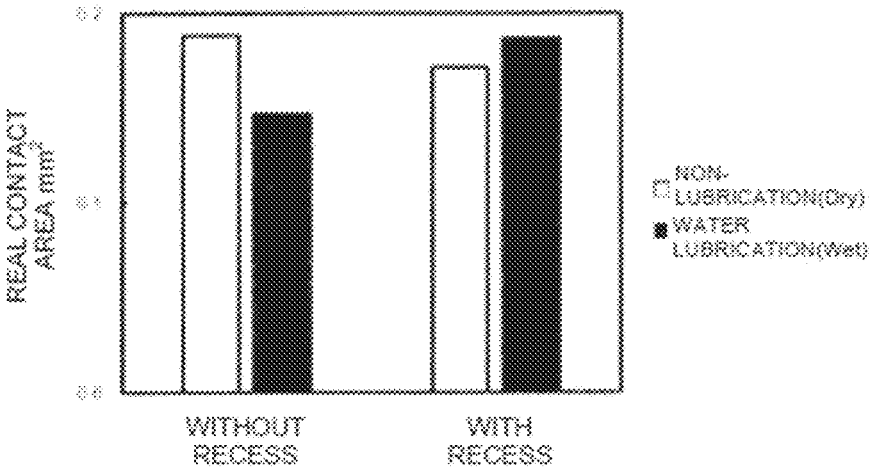
FIG. 13 is a graph showing the results of the reference experiment.
Figure 14:
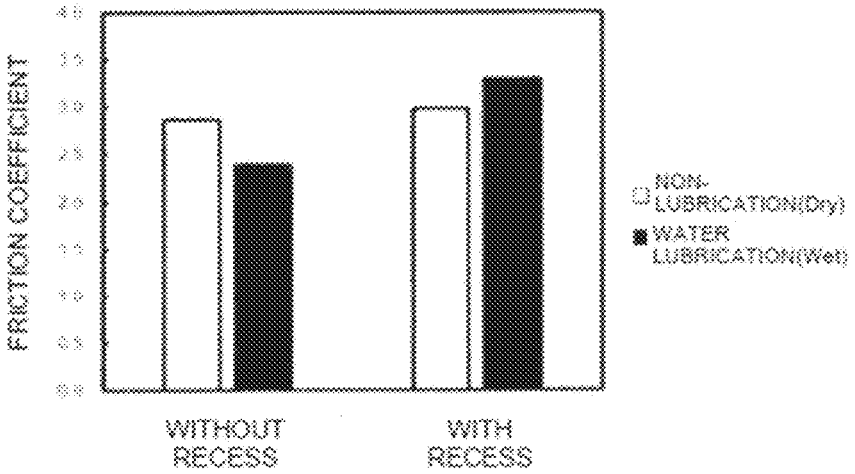
FIG. 14 is a graph showing the results of the reference experiment.

FIG. 13 and FIG. 14 show the real contact area and the friction coefficient, respectively, when 5.0-mm sliding was applied under the lubrication condition or the non-lubrication condition. Under the non-lubrication condition, the hollow formed in the ground-contacting surface of the rubber specimen causes a decrease in real contact area, but the presence of the hollow has little influence on the friction coefficient. On the other hand, under the water-lubrication condition, the hollow formed in the ground-contacting surface of the rubber specimen increases the real contact area and the friction coefficient by 37.7% and 27.4%, respectively. Thus, in the absence of the hollow in the ground-contacting surface of the rubber specimen, the presence of water in the contact interface under the water-lubrication condition decreases the friction coefficient. In contrast, in the presence of the hollow in the ground-contacting surface of the rubber specimen, the presence of water in the contact interface under the water-lubrication condition increases the friction coefficient.

INDUSTRIAL APPLICABILITY

The shoe sole member of the present invention is suitably used by disposition at the bottom of a shoe. The shoe of the present invention is suitably used under wearing it on the foot of a wearer. The shoe of the present invention is suitably used, for example, in application to a sport shoe.

DESCRIPTION OF REFERENCE NUMERALS

100: Shoe
10: Shoe sole member
11: Elastomer substrate
12: Particle
2: Outer sole
3: Midsole
5: Upper member

The invention claimed is:

1. A shoe sole member having an outer surface at least part of which serves as a ground-contacting surface, the shoe sole member comprising an elastomer substrate and a plurality of particles embedded inside the elastomer substrate, wherein a material for the particles includes at least one selected from the group consisting of a silicone, a polyurethane, a polystyrene, a polyolefin, and a polyvinyl acetate, and is different from a material for the elastomer substrate, and wherein the particles are contained in the shoe sole member in an amount of 1 vol % or more and 4 vol % or less.

2. The shoe sole member according to claim 1, wherein a durometer A hardness of the shoe sole member is 80 or less.

3. The shoe sole member according to claim 1, wherein at least some of the particles have a spherical shape.

4. The shoe sole member according to claim 1, wherein an average aspect ratio of the particles is within the range of 1:1 to 1:10.

5. The shoe sole member according to claim 1, wherein the particles have an average particle diameter of 1 μm or more and 100 μm or less.

6. A shoe comprising the shoe sole member according to claim 1.

* * * * *